United States Patent [19]

Stewart

[11] Patent Number: 4,756,034

[45] Date of Patent: Jul. 12, 1988

[54] MOTORIZED SEAT-BED

[76] Inventor: David Stewart, 29391 U.S. 33 West, Elkhart, Ind. 46516

[21] Appl. No.: 935,753

[22] Filed: Nov. 28, 1986

[51] Int. Cl.[4] ..... A47C 17/04

[52] U.S. Cl. ..... 5/37 Z; 5/41; 5/47; 5/48

[58] Field of Search ..... 5/17, 18 R, 18 B, 51 R–51 C, 5/41, 47, 48; 297/330

[56] References Cited

U.S. PATENT DOCUMENTS

| | | | |
|---|---|---|---|
| 2,684,708 | 7/1954 | Luketa | 297/330 |
| 2,964,095 | 12/1960 | Hoffman, Jr. et al. . | |
| 3,458,877 | 8/1969 | Edwards | 5/47 |
| 3,800,337 | 4/1974 | Mizelle . | |
| 3,816,860 | 6/1974 | Quakenbush . | |
| 3,913,152 | 10/1975 | Quakenbush . | |
| 4,001,901 | 1/1977 | Quakenbush . | |
| 4,037,872 | 7/1977 | Quakenbush . | |
| 4,186,980 | 2/1980 | Mizelle . | |
| 4,321,716 | 3/1982 | Shrock . | |
| 4,563,784 | 1/1986 | Shrock . | |
| 4,569,093 | 2/1986 | Hermann | 5/37 R |

OTHER PUBLICATIONS

Mechanisms Previously Used by Better Products–Settlement Agreement, Mar. 8, 1983.

*Primary Examiner*—Michael F. Trettei

*Attorney, Agent, or Firm*—Barnes & Thornburg

[57] ABSTRACT

A seat-bed assembly is provided having a conversion linkage fixedly attached to the seat member and disposed so as to restrict movement of the seat member during conversion. The seat member is slidable along a path determined by a guide track and avoids excess vertical motion. The conversion driver is mounted to the supporting frame and connects directly to the conversion linkage. The fixed connection of the conversion linkage to the seat member occurs at a rearward extension of the seat member. The back member includes a support projection on its rear surface which rests on that rearward extension to provide increased stability to the back member in the bed position.

15 Claims, 2 Drawing Sheets

MOTORIZED SEAT-BED

BACKGROUND OF THE INVENTION

The present invention relates generally to motorized convertible seat-bed assemblies. More particularly, this invention relates to such assemblies mounted in motor vehicles.

A number of prior seat-bed assemblies are known which are manually convertible from a seating position to a bed position. One example of such a seat-bed assembly suitable for vehicular mounting is shown in U.S. Pat. No. 4,321,716 issued to Shrock. However, especially in campers and vans, it has been found to be desirable to provide a seat-bed assembly having automatic position conversion and, at the same time, simplify the conversion mechanism.

Prior motorized devices for seat-bed conversion are known. One example of such a device is shown in U.S. Pat. No. 4,321,716, issued to Shrock et al. However, these motorized devices have not always performed satisfactorily. For example, drive motors have been located between the seat frame and the inner wall of the vehicle in order to optimize storage space under the seat. Unfortunately, such dispositions can make repair and replacement of the drive motor elements more difficult. Likewise it is difficult to retrofit a manual conversion assembly to a motorized unit with such arrangements.

Also, some pivotal linkages and multi-track guides for the seat member can cause the front of the seat to rise significantly during conversion. In such cases it may be difficult or impossible for the seat-bed to be occupied during conversion. At the same time, the cushion elements of some assemblies are undesirably compressed or worn by such vertical motion.

Further, some prior linkage arrangements are susceptable to binding during conversion, especially when the seat-bed is occupied. In addition, it has been found to be desirable to improve the load-bearing capacity and relative stability of the seat and back members especially in the bed position.

Accordingly, it is an object of this invention to provide an improved seat-bed assembly.

Another object is to provide a seat-bed assembly having increased leverage in the conversion mechanism so as to decrease the necessary drive motor force.

A further object is to provide improved stability and occupant support in seat-bed assemblies at minimal expense.

Yet another object is to provide a seat-bed conversion device which applies reduced strain on cushion components of the seat and back members.

Still another object is to provide a drive motor device for seat bed assemblies which is readily accessible for servicing.

Yet still another object is to provide a drive motor device which can be retrofit into seat-bed assemblies already installed in motor vehicles.

Still a further object is to provide a reliable seat-bed assembly which can be adjusted into a plurality of intermediate positions even when occupied.

These and other objects of the present invention are attained by the provision of a seat-bed assembly having a conversion linkage fixedly attached to the seat member and disposed so as to restrict movement of the seat member during conversion. The seat member is slidable along a path determined by a guide track and avoids excess vertical motion. The conversion driver is mounted to the supporting frame and connects directly to the conversion linkage. The fixed connection of the conversion linkage to the seat member occurs at a rearward extension of the seat member. The back member includes a support projection on its rear surface which rests on that rearward extension to provide increased stability to the back member in the bed position.

In particular, the seat-bed assembly includes a seat member, a back member, side frame members and a conversion linkage on each side which is fixed to the seat member, pivotally mounted to the back member and slidably mounted to the side frame member. A threaded drive rod and drive nut device are mounted to the linkage at the fixed connection to the seat member. The drive rod is selectively rotated by a worm gear mounted on the side frame member. The worm gears on each side are connected to a central drive motor by speedometer-type cables. The central drive motor is located on a bridging element joining each side frame member under the seat member.

The conversion linkage fixed to the seat member includes two spaced apart links. Rollers are mounted on the free ends of these links and disposed within a single roller guide track on the side frame member. The guide track is disposed in the direction of desired seat member motion during conversion. The conversion linkage connects to the back member through a pivotable joint with at least one of the links at the guide track roller.

Other objects, advantages and novel features of the present invention will now become readily apparent upon consideration of the following descriptions of preferred embodiments in conjunction with the drawings.

DETAILED DESCRIPTION OF THE PREFERRED EMBODIMENTS

Figure 1:
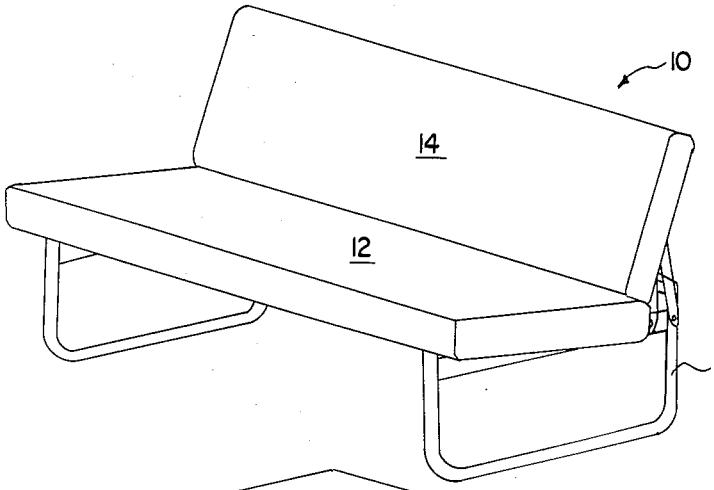
FIG. 1 is a front right perspective view of a seat-bed assembly according to the present invention in its seating position.
Figure 2:
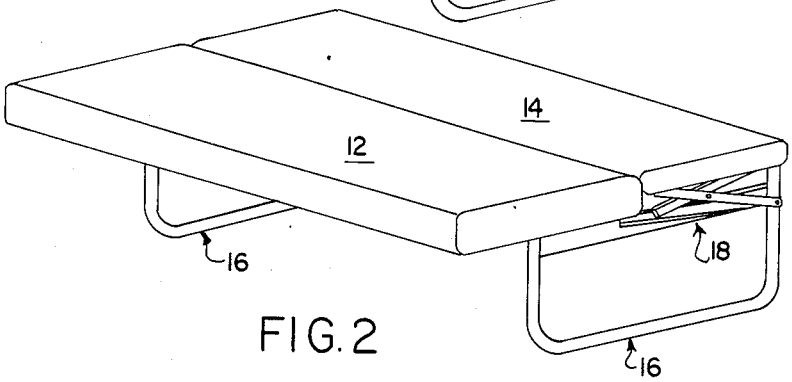
FIG. 2 is a front right perspective view of the device of FIG. 1 in its bed position.

The drawings, which illustrate a preferred embodiment of the present invention, show a seat-bed assembly 10 prior to mounting in a motor vehicle, such as van or camper. Seat-bed assembly 10 includes a plurality of body supporting members which are preferrably upholstered cushions. In particular, the seat-bed assembly includes seat portion 12 and back portion 14. These body supporting members are movably mounted on a frame 16 which provides fixed support for the seat-bed assembly. Seat portion 12 and back portion 14 are adjustable with respect to frame 16 between a seating position (as shown in FIG. 1) and a bed position (as shown in FIG. 2). In preferred embodiments of the present invention, various intermediate positions are also available.

Figure 3:
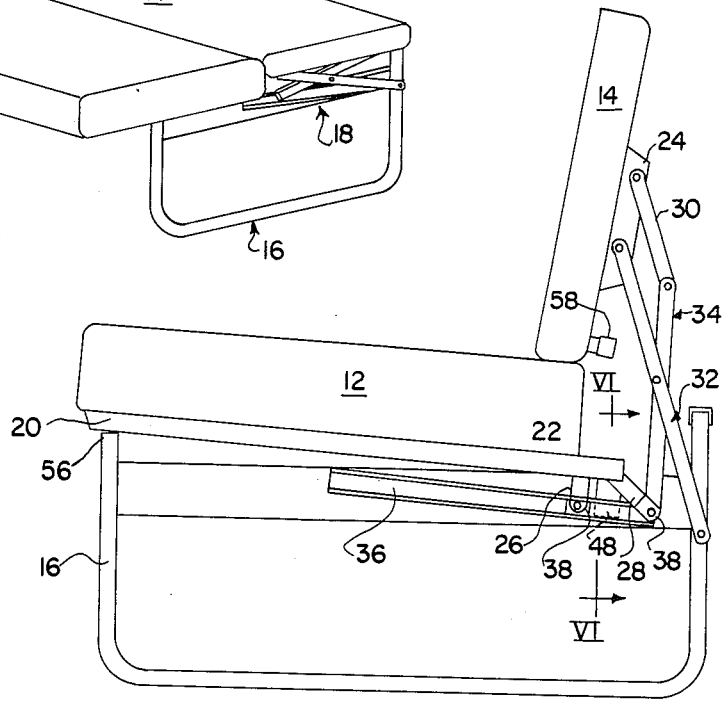
FIG. 3 is a right side view of the device of FIG. 1 in its seating position.
Figure 4:
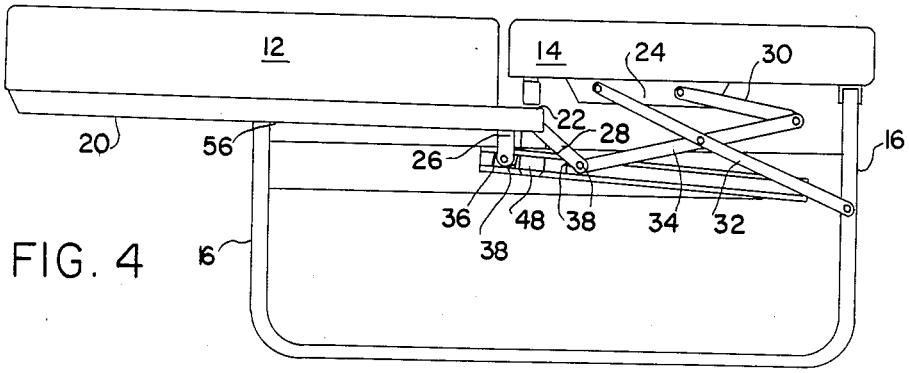
FIG. 4 is a right side view of the device of FIG. 1 in its bed position.
Figure 6:
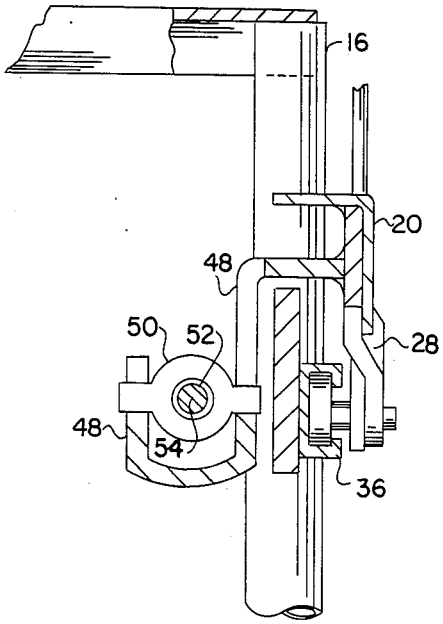
FIG. 6 is an enlarged cross-sectional view taken along line VI—VI in FIG. 5.
Figure 5:
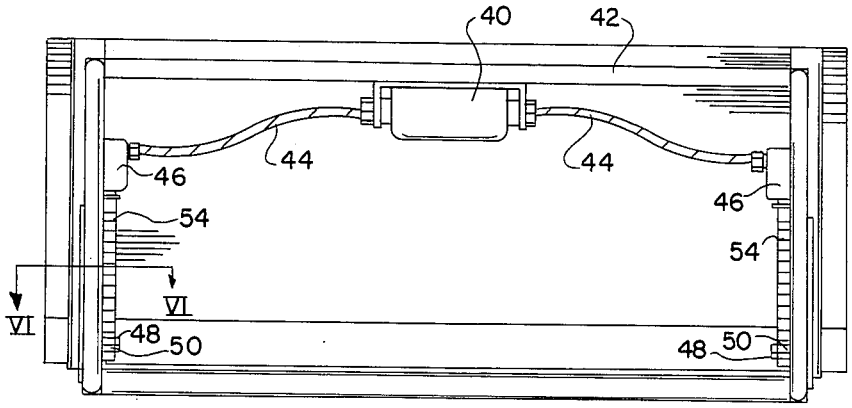
FIG. 5 is a bottom view of the device of FIG. 1 in its seating position.

Seat portion 12, back portion 14 and frame 16 are interconnected by linkage arrangement 18. FIGS. 3 and 4 illustrate the details of a preferred linkage arrangement as viewed from the right side of the seat-bed assembly. A corresponding linkage arrangement is, for example, similarly mounted on the left side of the seat-bed assembly also.

Seat portion 12 is typically includes a support bracket 20 mounted to its lower surface. Support bracket 20 preferably includes a portion 22 which extends rearwardly beyond the seat portion. Support bracket 20 can, for example, be formed from a length of angle iron. Similarly, back portion 14 includes a support bracket 24 mounted to its rear surface. Linkage arrangement 18 interconnects the seat and back portions through their respective support brackets.

Link members 26 and 28 are fixedly attached to support bracket 20 at spaced apart locations. Preferably, these link members are connected below rearward portion 22. In the illustrated embodiments, forward link 26 extends downwardly from support bracket 20 and rearward link 28 extends at a downward angle to the rear. Thus, link members 26 and 28 are spaced further apart at their lower ends than at their connection to support bracket 20.

Linkage arrangement 18 also includes a folding link assembly permitting back portion 14 to shift from vertical to horizontal positions. Link members 30 and 32 are each pivotally connected at one of their ends to support bracket 24 at spaced apart locations. The other end of link 30 is pivotally connected to an end of link 34. The other end of link 32 is pivotally connected to a rear portion of frame 16. An intermediate portion of link 32 is also pivotally connected to an intermediate portion of link 34. The free end of link 34 is pivotally connected to the lower end of link 28.

Frame 16 also includes a roller guide track 36 fixedly mounted below seat portion 12. Preferably, guide track 36 provides a substantially linear roller path and is inclined so as to be lower at its rearward portion. The roller path length of guide track 36 typically corresponds with the maximum length that seat portion 12 slides between seating and bed positions.

Links 26 and 28 each have roller elements 38 mounted at their lower ends. These roller elements are received within and retained by guide track 36. In preferred embodiments guide track 36 has a stop at its rear end to prevent accidentally dislodging of the roller elements. Also, guide track 36 typically has a width slightly greater than diameter of roller elements 38 so as to permit some vertical "play".

Automatic conversion and adjustment of the seat-bed position is available through the conversion drive assembly. Drive motor 40 is, for example, mounted beneath the front of seat portion 12 on bridging member 42. This bridging member preferably connects the left and right sides of frame 18. Drive motor 40 can be electrically or hydraulicly actuated. A conveniently located switch mechanism (not shown) can be employed to turn the drive motor on and off in forward and reverse directions. In the illustrated embodiment, it is contemplated that drive motor 40 includes two rotational outputs, corresponding to the two linkage arrangements employed on either side of frame 18. Alternatively, two separate, synchronized drive motors can be utilized, each having a single rotational output. One such suitable electric drive motor is a 12 volt D.C. motor of the type available from Stock Drive Products of New Hyde Park, N.Y.

Drive transmitting cables 44 are connected at one end to each rotational output of drive motor 40. These cables are, for example, speedometer type cables intended to supply rotational motion to remote locations. In the present invention, the drive transmitting cables are connected at their other end to separate worm gear drives 46. One of these gear drives is preferably fixedly mounted on each interior side of frame 16 at a location forward of guide track 36. A drive nut bracket 48 is provided which is, for example, fixed to each link 28. Drive nut 50 is removably mounted in bracket 48. Drive nut 50 includes a threaded interior bore 52 and is fixed in bracket 48 with respect to forward or rearward movement. A correspondingly threaded drive rod 54 is rotatably mounted in each gear drive 46 and extends through the threaded bore in each drive nut.

In operation, the rotational output of drive motor 40 is transmitted through cables 44 to the worm gear drives. Each worm gear drive thereby causes drive rod 54 to rotate. Drive rods 54 do not travel longitudinally with respect to gear drives 46 as a result of this rotation. However, due to their threaded connection, each drive nut 50 is displaced by the rotation of its respective drive rod 54. Depending upon the direction of rotation, drive nut 50 moves forward or rearward with respect to frame 16.

Since drive nut 50 is fixed in bracket 52 with respect to forward and rearward motion, link 28, support bracket 20, and seat portion 12 are likewise urged forward or rearward. The movement of seat portion 12 is restricted by the path permitted by guide track 36.

Roller elements 38 on links 26 and 28 permit seat portion 12 to roll or slide forward or rearward along a path substantially parallel to that of the guide track. The lower front region of seat portion 12 is illustrated as being supported by bracket 20 resting on a front member 56 of frame 16. In preferred embodiments, that front member can be provided with a friction reducing surface so as to facilitate sliding of the seat portion between seating and bedding positions.

Since the guide track is inclined so as to be lower at its rear, seat portion 12 will be similarly inclined when in the seating position. However, because of the vertical play in the guide track, seat portion 12 is preferably less inclined when in its bed position. As roller elements 38 move forward and upward along guide track 36, more of seat portion 12 extends past front member 56. At a particular forward position, for example, the leveraged weight of seat portion 12 lifts the roller element of link 28 vertically within guide track 36.

Because of the pivotal connection of link 34 to link 28, the position of back portion 14 is simultaneously adjusted along with the position of seat portion 12. Forward movement of drive nut 50 causes the link assembly to fold downward beneath the back portion. As a result, back portion 14 preferably lies horizontal and flush with seat portion 12 when the seat portion is in its forward-most position. The linkage arrangement is typically sufficiently rigid to stabilize the back portion against any tilting when in this bed position. However, in especially preferred embodiments the present invention includes an additional support projection 58. This projection is, for example, fixed to the lower rear surface of the back portion and is dimensioned so as to register with the upper surface of rear extension portion 22 when back portion 14 is in the bed position. Alternatively, back portion 14 itself can be dimensioned to register with the upper surface of portion 22.

Rearward movement of drive nut 50 causes roller element 38 of link member 28 to roll or slide back on guide track 36, thereby forcing the lower portion of link 34 toward the rear of the support frame. This action unfolds the linkage assembly and raises back portion 14 toward the more vertical seating positions. In the motorized embodiments of the present invention, the gear drive and threaded inter-connection of the drive nut and drive rod can provide a collision lock to prevent the seat portion from sliding forward. Also in motorized and non-motorized embodiments, various conventional safety linkages or collision locks can be utilized.

Thus, the present invention provides an improved convertible seat-bed assembly. This invention has particular advantages when mounted in a vehicle, but residential and commercial applications can also be benefitted. The conversion drive means can also be easily retrofit onto pre-existing non-motorized seat-bed assemblies by direct connection to the conversion linkage from beneath the seat.

This conversion drive means permits a wide variety of seat-bed adjustments to be made. Further, since the inventive linkage arrangement does not unduly raise the seat cushion during conversion, the seat-bed can actually be occupied while it is adjusted. Also, the linear, slide-type conversion motion helps to minimize the power required by the conversion drive motor.

The rigid, two point connection of the seat to the conversion linkage permits the guide track to provide improved seat stability and load support. At the same time, the opportunity for roller binding within the guide track is significantly reduced.

Although the present invention has been described in detail, the same is by way of illustration and example only and is not to be taken by way of limitation. The spirit and scope of the present invention are to be limited only by the terms of the appended claims.

What is claimed is:

1. A seat-bed assembly convertible between at least a seating position and a bed position, comprising:

a seat member;

a back member;

a frame member having guide means therein;

said guide means comprising a single track on at least one side of the frame member;

linkage means for synchronizing movement of said seat member and said back member between said seating and said bed positions;

said linkage means including a first portion fixedly connected to said seat member and slidably connected to said guide means;

said linkage means also including a second portion pivotably connected to both said back member and said first portion;

said first portion of said linkage means being disposed so as to restrict movement of said seat member to a path substantially parallel to said guide means during conversion between said seating position and said bed position as well as in the seat and bed positions;

said first portion of said linkage means includes at least first and second spaced-apart link members for supporting said seat member within said guide means; and drive means mounted on said frame member and connected to said linkage means for controlling said movement of said seat member and said back member.

2. The seat-bed assembly according to claim 1 wherein said first portion of said linkage means includes at least first and second spaced-apart link members for supporting said seat member within said guide means, said first and second link members having roller elements within said guide means said roller elements retained in two directions by said guide means whereby said roller elements support both compression forces and tensile forces from cantilevered loads placed upon a forward portion of said seat support.

3. The seat-bed assembly according to claim 2 wherein said guide means includes a single, roller receiving track and said link members each have rollers mounted at one of the ends thereof, said rollers being received within said track to provide said slidable connection with said first portion of said linkage means.

4. The seat-bed assembly according to claim 1 wherein said drive means includes a gear drive, a drive screw and a drive nut, said gear drive being mounted on said frame member, said drive nut being mounted in a bracket fixed with respect to said first portion of said linkage means, and said drive screw being operably supported by said gear drive and said drive nut and spanning the distance therebetween.

5. The seat-bed assembly according to claim 4 wherein said first portion of said linkage means includes a plurality of spaced apart link members fixed with respect to said seat member for supporting said seat member a plurality spaced apart locations on said guide means.

6. The seat-bed assembly according to claim 5 wherein said bracket is directly attached to one of said link members.

7. The seat-bed assembly according to claim 1 wherein said seat member includes a rearward extension and said first portion of said linkage means is fixedly connected to said seat member beneath said rearward extension.

8. The seat-bed assembly according to claim 7 wherein said back member includes a support element engagable with said rearward extension when said seat-bed assembly is in the bed position for supporting said back member against further vertical movement.

9. A seat-bed assembly convertible between at least a seating position and a bed position, comprising:

a seat member having an upper surface and a lower surface and including a seat support element connected to said lower surface;

said seat support element extending rearwardly beyond said seat member;

a back member having a front and a rear surface and including a back support element connected to said rear surface;

a frame member for supporting said seat and back members, said seat and back members being movably mounted with respect to said frame member between the seating and bed positions;

a linkage means for moving said seat member and said back member in coordination between the seating and bed positions;

said linkage means being fixedly connected to said seat support element, slidably connected to said frame member, and pivotably connected to said back support element; and a support projection means attached to said rear surface for engagement with said rearward extension of said seat support element to restrict further vertical movement of said back member in the bed position.

10. A seat-bed assembly for use in motor vehicles, comprising:

a frame means for supporting said seat-bed assembly, said frame means being fixed with respect to the vehicle;

a first body supporting member slidably mounted with respect to said frame means;

a second body supporting member movably mounted with respect to said frame means;

linkage means for controlling relative movement of said first and second body supporting members;

said linkage means including a first portion fixedly connected to said first body supporting member and a second portion pivotally connected to said second body supporting member;

said first and second portions being pivotally connected;

said frame means including guide means for receiving and retaining said first portion along a predetermined path;

said guide means comprising a single track on at least one side of the frame member;

said first portion being connected to said frame means through said guide means so as to restrict sliding movement of said first body supporting member to a path substantially parallel to said predetermined path of said guide means;

said first portion of said linkage means including at least first and second spaced-apart link members for retaining said first body supporting member within said guide means, whereby said first body supporting member is supported by said first and second links engaging said guide means thereby absorbing both compressive forces and tensile forces.

11. A motorizing kit for vehicular mounted seat-bed assemblies having a seat supporting frame with left and right side members and a bridging member therebetween, a seat member, a back member and a linkage means connected to said frame, said seat member and said back member to control relative movement of said seat member and said back member, comprising:

a drive motor adapted to be mounted to said bridging member;

first rotational drive member adapted to be mounted on said left side member;

second rotational drive member adapted to be mounted on said right side member;

first drive transmitting cable adapted to be mounted between said drive motor and said first rotational drive member;

second drive transmitting cable adapted to be mounted between said drive motor and said second rotational drive member;

first and second threaded rods adapted to be mounted for rotation in said first and second rotational drive members, respectively; and first and second drive nut means adapted to be mounted directly to said linkage means for receiving said first and second threaded rods, respectively.

12. A seat-bed assembly convertible between at least a seating position and a bed position, comprising:

a seat member;

a back member;

a frame member having guide means therein;

said guide means comprising a single track on at least one side of the frame member;

linkage means for synchronizing movement of said seat member and said back member between said seating and said bed positions;

said linkage means including a first portion fixedly connected to said seat member and slidably connected to said guide means;

said linkage means also including a second portion pivotably connected to said back member and slidably connected to said guide means;

said first portion of said linkage means being disposed so as to restrict movement of said seat member to a path substantially parallel to said guide means; and drive means mounted on said frame member and connected to said linkage means for controlling said movement of said seat member and said back member;

said drive means includes a gear drive, a drive screw and a drive nut, said gear drive being mounted on said frame member, said drive nut being mounted in a bracket directly attached to one of said link members and fixed with respect to said first portion of said linkage means, and said drive screw being operably supported by said gear drive and said drive nut and spanning the distance therebetween;

said linkage means includes a plurality of spaced apart link members fixed with respect to said seat member for supporting said seat member by a plurality spaced apart locations on said guide means.

13. A seat-bed assembly convertible between at least a seating position and a bed position, comprising:

a seat member;

a back member;

a frame member having guide means therein;

said guide means comprising a single track on at least one side of the frame member;

linkage means for synchronizing movement of said seat member and said back member between said seating and said bed positions; and drive means mounting on said frame member and connecting to said linkage means for controlling said movement of said seat member and said back member;

said linkage means including a first link fixedly connected to said seat member and slidably connected to said guide means;

said linkage means also including a second link pivotably connected to said first link and pivotably connected to said back member;

said linkage means further including a third link fixedly connected to said seat member and slidably connected to said guide means;

said first and third link of said linkage means being disposed so as to restrict movement of said seat member to a path substantially parallel to said guide means and to partially support said seat member;

said seat member including a rearward extension and said first link of said linkage means is fixedly connected to said seat member beneath said rearward extension;

said back member including a support element engagable with said rearward extension when said seat-bed assembly is in the bed position for supporting said back member against further vertical movement.

14. A seat-bed assembly, comprising:

a seat member;

a back member;

a frame member having a guide means therein;

said guide means comprising a single track on at least one side of the frame member;

a linkage means connecting said seat member, said back member, and said frame member;

said guide means also retaining said back member to said frame member; and a double roller means for restricting movement of said seat member to a plane of travel substantially parallel to said guide means;

said double roller means including at least two links with rollers on one end engagable with said guide means and fixedly connected to said seat member on the other end to partially support said seat member both in the seat and bed positions and during conversion from a seat to a bed.

15. The seat-bed of claim 14 wherein said double roller means connects to said linkage means at a rearward extension of said seat member.

* * * * *

UNITED STATES PATENT AND TRADEMARK OFFICE

CERTIFICATE OF CORRECTION

PATENT NO. : 4,756,034

DATED : July 12, 1988

INVENTOR(S) : David Stewart

It is certified that error appears in the above-identified patent and that said Letters Patent is hereby corrected as shown below:

On the title page,

In Section [56] of the abstract page, please delete "Trettei" and insert therefor -- Trettel --.

In Column 3, line 8, please delete "is".

Signed and Sealed this

Seventeenth Day of January, 1989

*Attest:*

DONALD J. QUIGG

*Attesting Officer*

*Commissioner of Patents and Trademarks*